US006603088B2

(12) United States Patent
Grejon et al.

(10) Patent No.: US 6,603,088 B2
(45) Date of Patent: Aug. 5, 2003

(54) PRESSURIZED GAS CIRCUIT-BREAKER POLE THAT CAN BE ASSEMBLED AND DISASSEMBLED WITHOUT SIGNIFICANT LOSS OF GAS

(75) Inventors: Olivier Grejon, Sathonay Camp (FR); Michel Nauche, Pierre Benite (FR); Serge Paolozzi, Lyons (FR); Bernard Raynaud, Rillieux la Pape (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/187,954

(22) Filed: Jul. 3, 2002

(65) Prior Publication Data

US 2003/0015337 A1 Jan. 23, 2003

(30) Foreign Application Priority Data

Jul. 6, 2001 (FR) ..... 01 09006

(51) Int. Cl.[7] ..... H01H 33/70

(52) U.S. Cl. ..... 218/68; 218/43; 174/28; 174/21 R

(58) Field of Search ..... 218/43, 68, 155, 218/97, 118, 135, 136; 174/21 R, 28, 21 JS, 21 CA

(56) References Cited

U.S. PATENT DOCUMENTS 4,024,339 A * 5/1977 Meyer et al. ..... 174/21 C
4,302,064 A * 11/1981 Spinner ..... 439/198
4,612,428 A * 9/1986 Nicoloso ..... 218/43
4,774,387 A * 9/1988 Nicoloso ..... 218/143
5,416,266 A * 5/1995 Muller ..... 174/21 C

FOREIGN PATENT DOCUMENTS

| | | |
|---|---|---|
| CH | 622 376 A5 | 3/1981 |
| FR | 2 415 358 | 8/1979 |
| FR | 2 568 405 | 1/1986 |

* cited by examiner

*Primary Examiner*—Elvin Enad
*Assistant Examiner*—M. Fishman
(74) *Attorney, Agent, or Firm*—Sughrue Mion, PLLC

(57) ABSTRACT

A pressurized gas circuit-breaker pole includes a first enclosure or pole head having a first envelope with a first connecting flange including a circular orifice. The envelope contains a first mobile assembly terminating in a coupling member coaxial with the orifice. A second enclosure constituting an insulative column includes a second envelope having a second connecting flange with a circular orifice. The second envelope contains a second mobile assembly having a link for maneuvering the first mobile assembly and its end including complementary arrangements for coupling it with the coupling member. The connecting flange of each enclosure has an annular elastomer seal fixed to the corresponding connecting flange and through which the corresponding mobile assembly passes. The seal of each enclosure provides, during assembly of the flanges and coupling of the internal mobile assemblies, a sliding seal. The seal is broken on completion of assembly.

5 Claims, 9 Drawing Sheets

PRESSURIZED GAS CIRCUIT-BREAKER POLE THAT CAN BE ASSEMBLED AND DISASSEMBLED WITHOUT SIGNIFICANT LOSS OF GAS

BACKGROUND OF THE INVENTION

1. Field of the Invention

The present invention relates to a pressurized gas circuit-breaker pole that can be assembled and disassembled without significant loss of gas and including a first enclosure or pole head including a first envelope including a first connecting flange including a circular orifice, said envelope containing a first mobile assembly terminating in a coupling member coaxial with said orifice, and a second enclosure constituting an insulative column including a second envelope including a second connecting flange including a circular orifice, said second envelope containing a second mobile assembly consisting of a link for maneuvering said first mobile assembly and its end including complementary means for coupling it with said coupling member.

2. Description of the Prior Art

The poles of large circuit-breakers, and in particular T-shaped poles with two interrupter chambers in series, cannot be transported to the installation site fully assembled: the head of the pole on the one hand, constituting a first enclosure containing all the active, fixed and mobile members of the two interrupter chambers, and the insulative column on the other hand, containing the link for maneuvering the mobile parts of the circuit-breaker pole, are therefore shipped in a disassembled state and assembled only on site.

It is necessary to evacuate the pole before filling it with a dielectric gas such as SF6. However, this operation requires a pump, which is not always available on site.

Also, this operation must be carried out in the manufacturing plant for each of the two parts of the pole: pole head and insulative column. Once the vacuum has been established, the two parts are filled with dielectric gas with an overpressure of the order of 0.3 bar and the parts are shipped to the site in this state. Once assembled, the gas pressure in the pole is set to its nominal value.

The problems therefore arise at assembly time of connecting the two enclosures and coupling the link to the coupling end of the mobile assembly without losing any gas or with minimum loss of gas and of providing gaseous communication between the two enclosures when assembly is complete.

The document FR-A1–2 568 405 describes a circuit-breaker in which the head of each pole includes a sliding airlock and the column includes a chimney, enabling coupling and decoupling with a small loss of gas corresponding to the combined volume of the airlock and the chimney. However, this necessitates several additional components, including the sliding airlock and a sliding jacket, as well as a special "chimney" conformation of the end of the column. Also, an additional travel of the mobile parts of the pole, beyond the closed position of the circuit-breaker, must be provided for.

The document FR 2 415 358 A describes a circuit-breaker which enables, by virtue of an inflatable seal, transportation of the insulative support before its assembly with the upper part, the insulative support having first been evacuated then filled with gas. However, there is no provision for the upper part and, furthermore, it is necessary to deflate the seal of the insulative column after assembly.

An object of the present invention is to propose a simplified solution requiring only a few components and enabling fast assembly and disassembly and requiring no operation other than that of assembling and pressurizing the pole with dielectric gas to the nominal value, the gaseous communication between the two enclosures being automatic and not demanding any additional operation.

SUMMARY OF THE INVENTION

The invention therefore provides a pressurized gas circuit-breaker pole that can be assembled and disassembled without significant loss of gas and including a first enclosure or pole head including a first envelope including a first connecting flange including a circular orifice, the envelope containing a first mobile assembly terminating in a coupling member coaxial with the orifice, and a second enclosure constituting an insulative column including a second envelope including a second connecting flange including a circular orifice, the second envelope containing a second mobile assembly including a link for maneuvering the first mobile assembly and having an end including a complementary coupling member for coupling the end with the coupling member, wherein the connecting flange of each enclosure is fitted with an annular elastomer seal fixed to the corresponding connecting flange and through which the corresponding mobile assembly passes, the seal of each enclosure providing, during assembly of the flanges and coupling of the internal mobile assemblies, a sliding seal along the respective mobile assemblies, and means being provided to break the seal along the mobile assemblies on completion of assembly by reversible and automatic deformation of the annular elastomer seal to establish communication between the two enclosures.

In a first embodiment of the invention the annular elastomer seals are tilting deformable seals.

Each of the tilting deformable seals advantageously includes an external anchor ring connected by an isthmus to a seal body including a heel and a lip and the heel of each seal projects beyond the exterior plane of the corresponding flange.

In a second embodiment of the invention the means for breaking the seal along the mobile assemblies include a slide whose axial length is greater than the distance between the two annular elastomer seals in the assembled position of the first and second envelopes.

In a third embodiment of the invention each of the annular elastomer seals includes a first peripheral part gripped between a flange and a backing flange, a second part constituting a deformable hollow ring including walls with more flexible parts and more rigid parts, and a central third part constituting a simple thin disc providing the sliding seal along the mobile assembly.

A few embodiments of the invention will now be described with reference to the accompanying drawings.

DETAILED DESCRIPTION OF THE PREFERRED EMBODIMENTS

Figure 1:
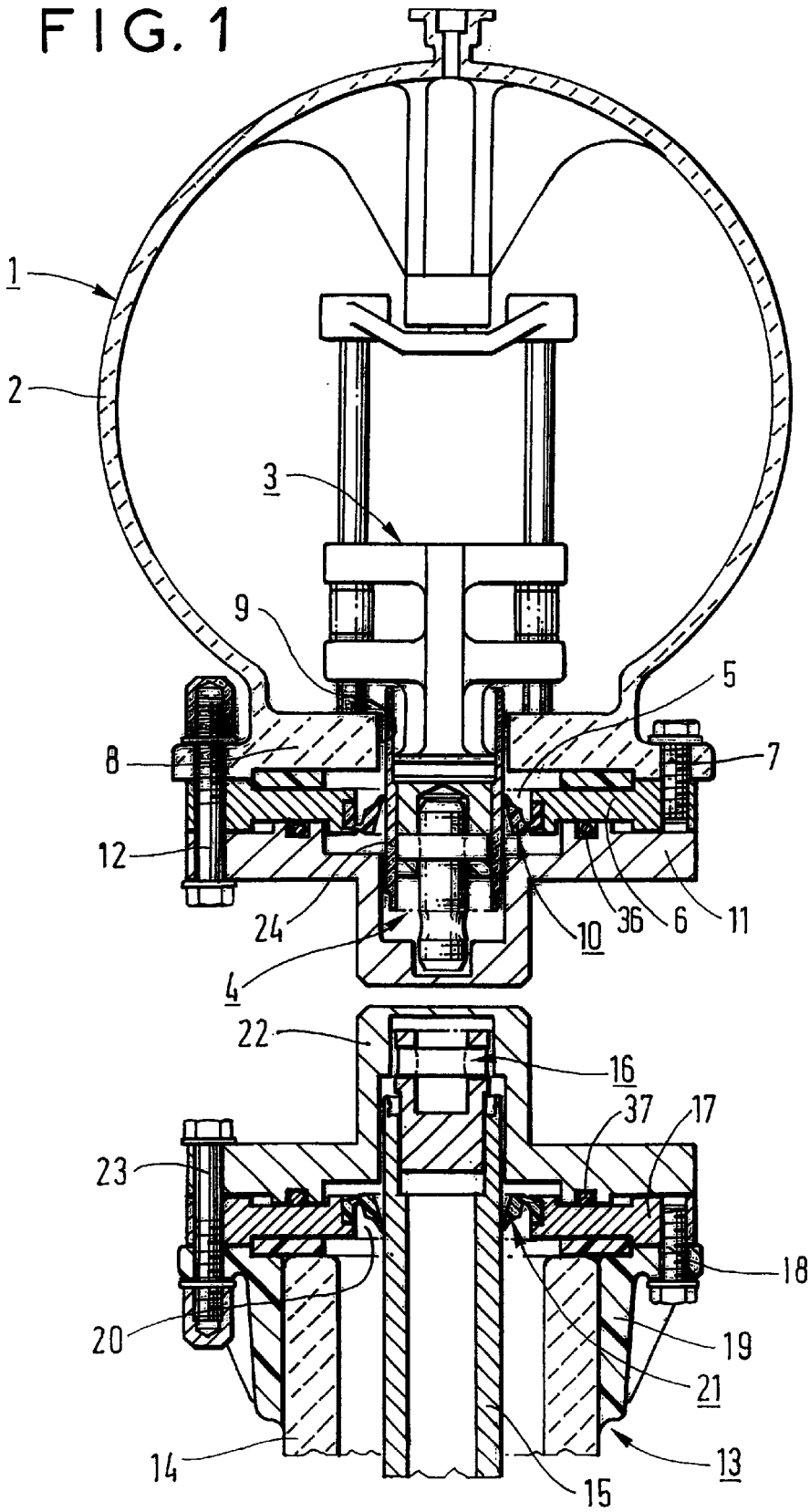
FIG. 1 shows the two parts of a first embodiment of a circuit-breaker pole in accordance with the invention prior to assembly.

FIG. 1 shows part of a circuit-breaker pole prior to assembly and including a first enclosure constituting the pole head 1 comprising a first envelope 2 containing a first mobile assembly 3 to which the active mobile parts of the circuit-breaker, not shown, are connected. The mobile assembly 3 terminates in a coupling member 4 coaxial with a circular orifice 5 of the envelope formed in a first connecting flange 6 attached and fixed by bolts 7 to a base 8 incorporating an opening 9 coaxial with the orifice 5.

The first connecting flange 6 is fitted with an annular elastomer seal 10 providing a sliding seal along the mobile assembly 3 between the inside and the outside of the envelope 2.

Before its assembly, the pole head 1 is closed by a cover 11 fixed by bolts 12 with an interposed seal 36. The cover 11 protects the coupling member 4.

A vacuum is established in the pole head, which is then filled with a dielectric gas at an overpressure of the order of 0.3 bar.

The pole head 1 must be assembled on site to a second enclosure 13 also filled with a dielectric gas. This is the insulative column of toe pole, which comprises a second envelope 14 containing a second mobile assembly 15 including a link for maneuvering the first mobile assembly 3, one end of which incorporates a complementary coupling member 16 for coupling it to the coupling member 4 of the mobile assembly 3.

The second envelope 14 includes a second connecting flange 17 fixed by bolts 18 to a base 19 of the envelope 14.

The second connecting flange 17 is provided with a circular orifice 20 and fitted with an annular elastomer seal 21 identical to the seal 10 and providing a sliding seal along the link 15 between the inside and the outside of the column 13.

Like the pole head 1, and before it is assembled to it, the column 13 is provided with a 7 cover 22 to protect the second mobile assembly 15 including coupling member 16, fixed by bolts 23 with an interposed seal 37.

Figure 2:
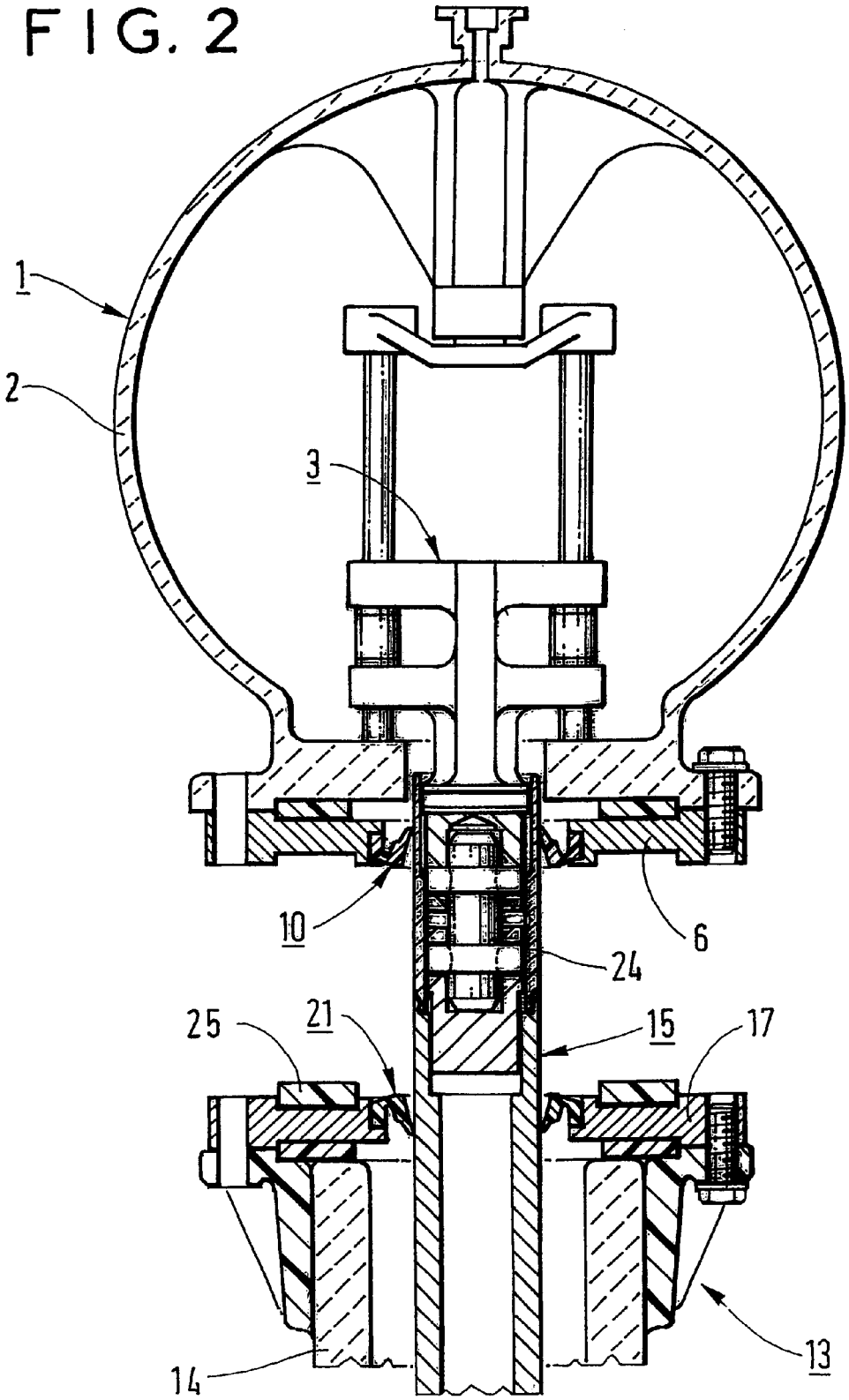
FIG. 2 shows the circuit-breaker pole from FIG. 1 during assembly.

The assembly member 4 is surrounded by a sliding jacket 24 assuring continuity and a constant diameter when the mobile assemblies have been coupled as shown in FIG. 2, in which the covers 11 and 22 have been removed, the two mobile assemblies 3 and 15 have been coupled, and the jacket 24 has then been slid downward so that the coupling members are covered by a smooth surface.

A seal 25 is placed on the flange 17 after removing the covers 11 and 12 and before coupling the mobile assemblies.

Figure 3:
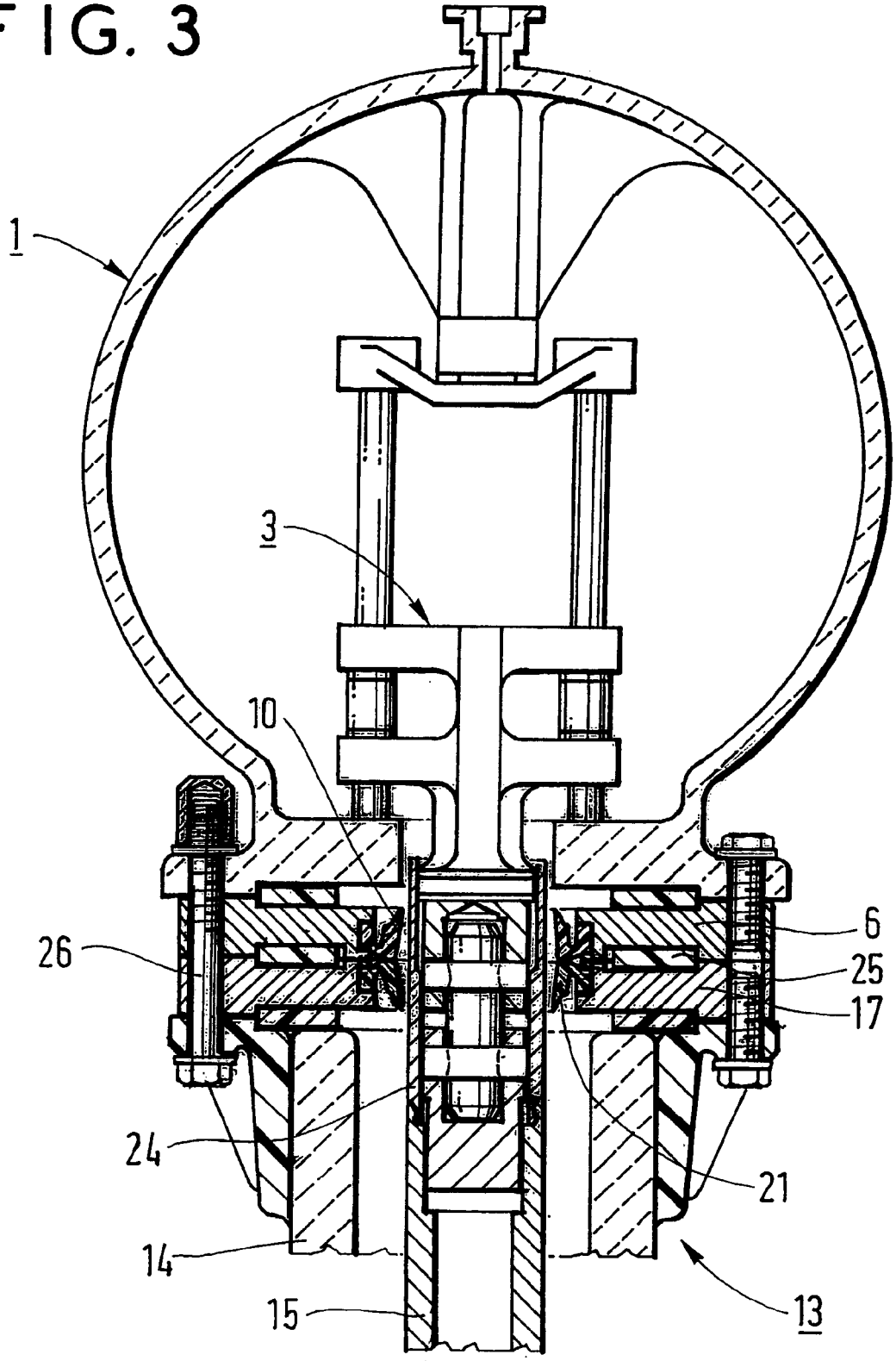
FIG. 3 shows the assembled pole.

Once the mobile assemblies have been coupled and the jacket 24 lowered, the pole head 1 is lowered in order to assemble the two flanges 6 and 17 with bolts 26, as shown in FIG. 3. During this descent, the seal 21 slides along the link 15 and the jacket 24.

On completion of coupling, when the two flanges 6, 17 come into contact, the seals 10 and 21 are deformed and are no longer in contact with the mobile assembly 1524, so providing gaseous communication between the two enclosures 1 and 13. To this end, as can be seen clearly in FIG. 4, which is to a larger scale, the seals 10 and 21 are deformable seals each incorporating an external anchor ring 26, 27 connected by an isthmus 28, 29 to a seal body 30, 31 including a lip 32, 33 and a heel 34, 35. The heels 34, 35 project beyond the exterior plane of the respective flanges 6, 17 so that when the flanges are assembled the heels 34 and 35 come into contact and cause the body of the seal 30, 31 to tilt about the isthmus 28, 29.

Figure 4:
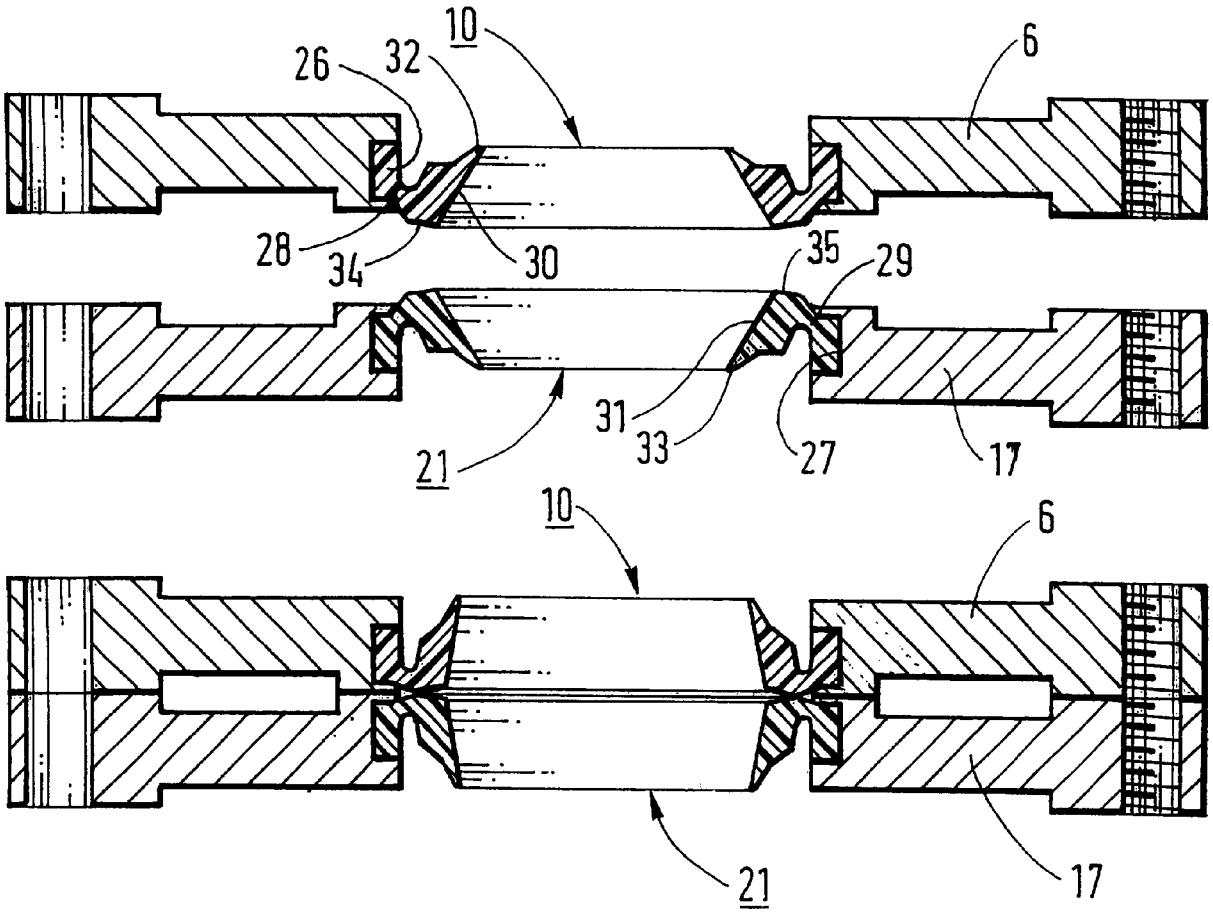
FIG. 4 shows to a larger scale, and in their respective positions before and after assembly of the two parts of the pole, the annular seals providing a sliding seal along the respective mobile assemblies during assembly.

Because of this tilting, which is clearly visible in the lower part of FIG. 4, the lips are no longer in contact with the jacket 24, as can be seen in FIG. 3. This deformation is reversible on disassembly.

Accordingly, by virtue of the invention, the head 1 and the column 13 are coupled and decoupled with the two parts respectively sealed and therefore without any lose of gas, and communication is established between the two enclosures automatically without any additional operation when coupling is completed. Of course, once assembly is completed, the pole is filled with dielectric gas to its nominal pressure.

Figure 5:
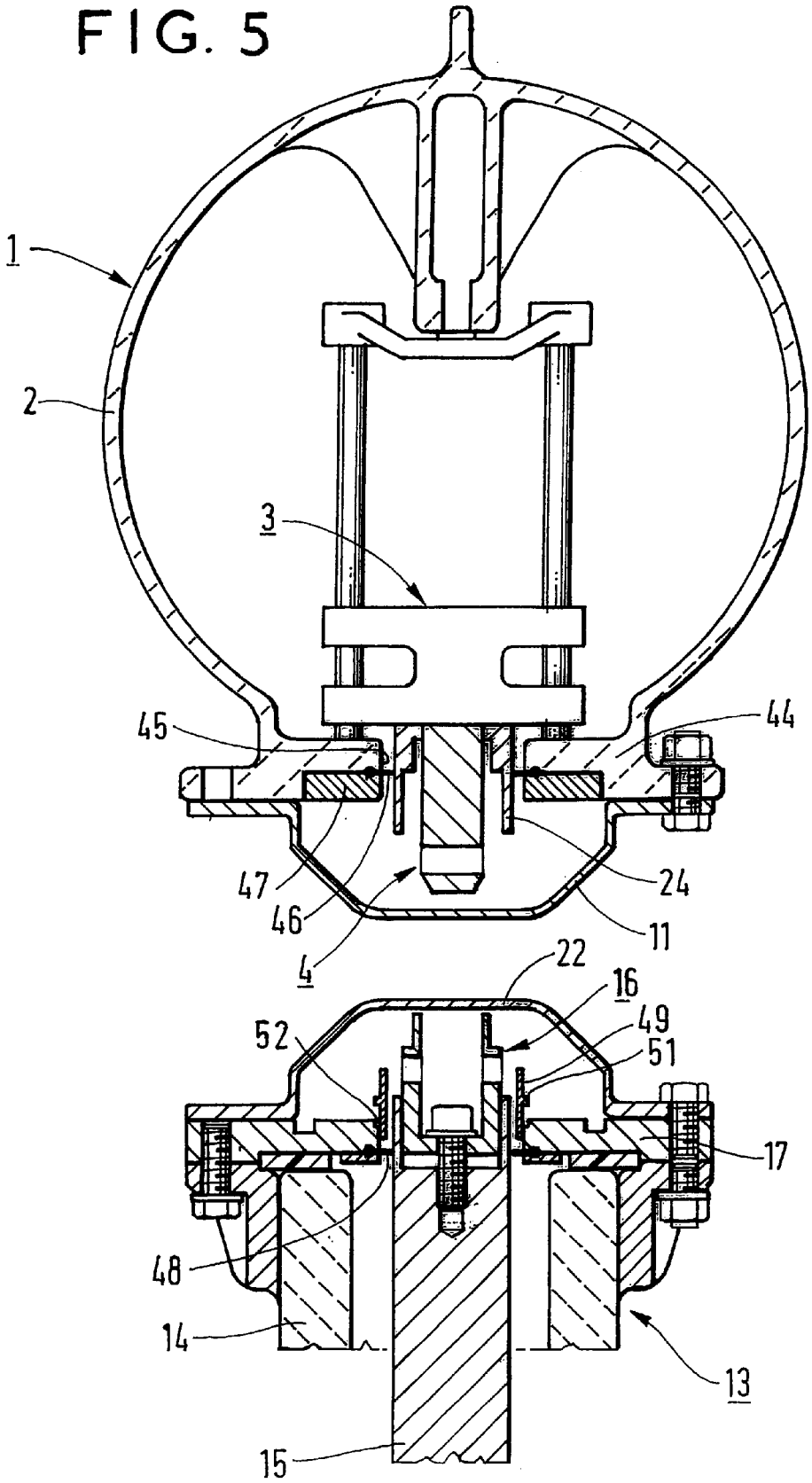
FIG. 5 is a view similar to that of FIG. 1 but relates to a second embodiment of the invention.
Figure 6:
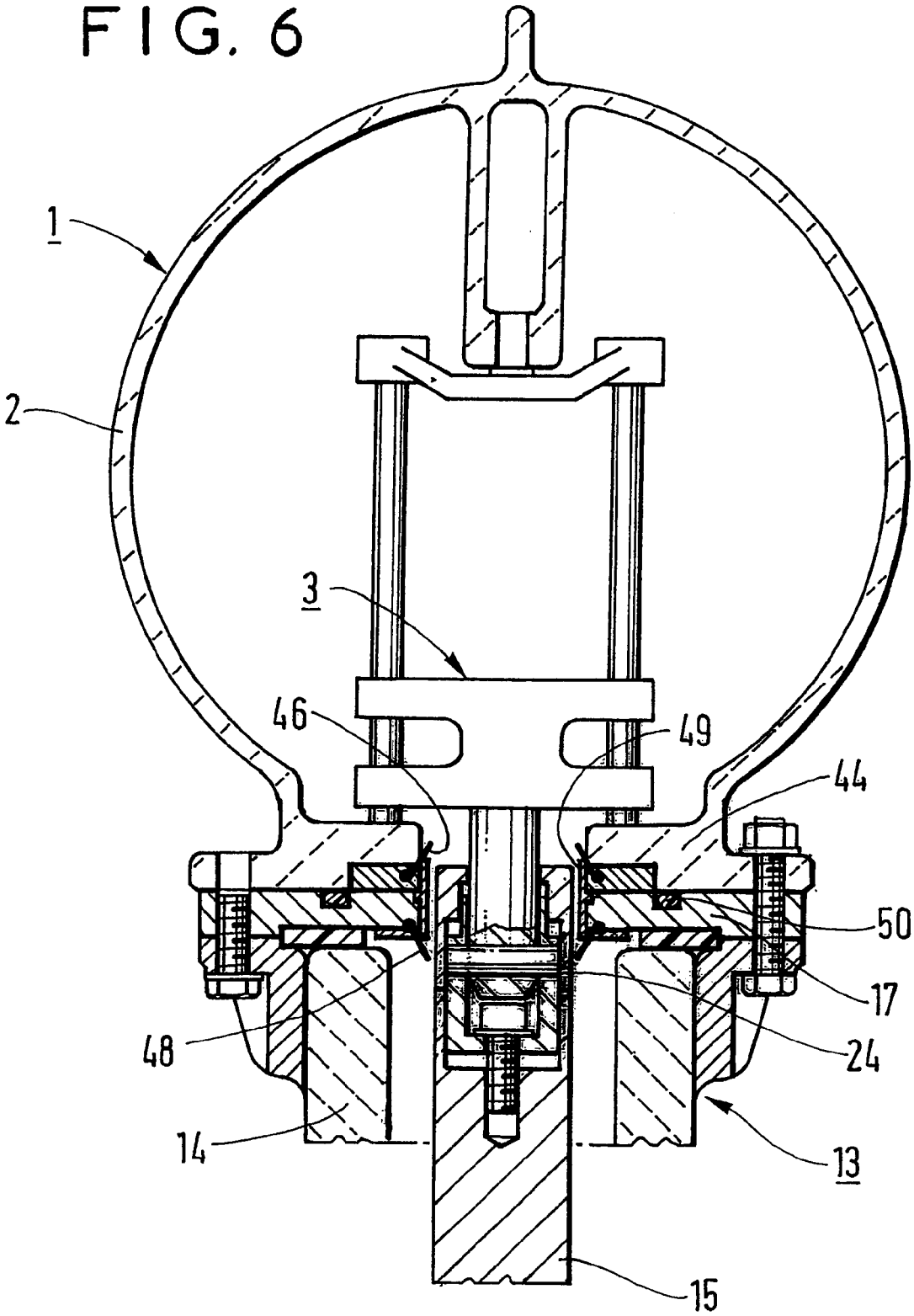
FIG. 6 shows the assembled pole.
Figure 7:
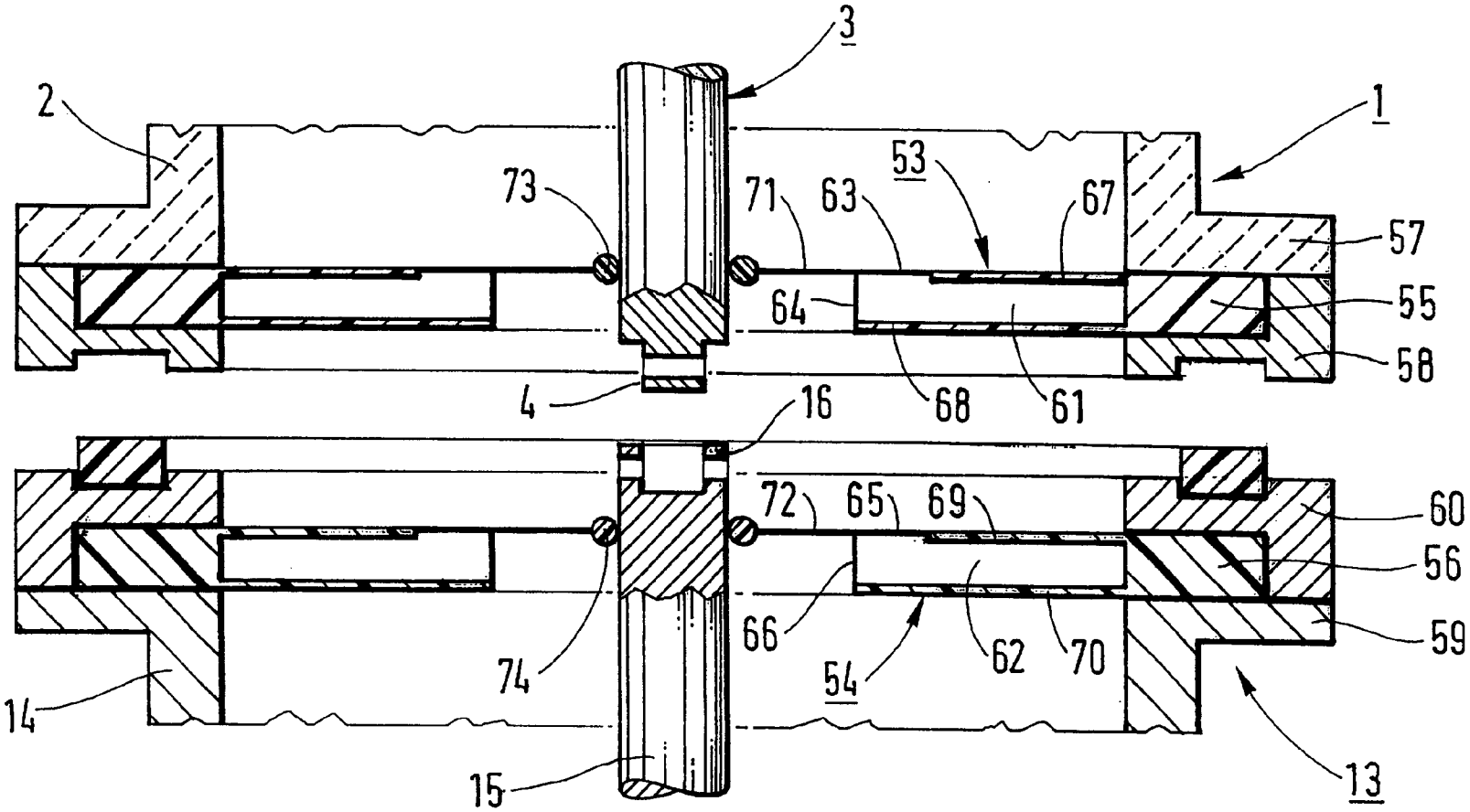
FIGS. 7 to 10 are diagrammatic views showing the steps of assembling a third embodiment of the invention.

FIGS. 5 and 6 show a second embodiment of the invention.

In this example, the envelope 2 of the head 1 includes a flange 44 with a circular orifice 45, the flange being fitted with an annular elastomer seal 46 which is a simple flat disc seal fixed by means of a backing flange 47. The seal 46 grips the sliding jacket 24.

In the same way, the flange 17 of the envelope 14 is fitted with an identical seal 48. In this embodiment, in order to "break" the seal provided by the seals 46, 48 on completion of assembly to provide communication between the two enclosures 1 and 13, the flange 17 is equipped, on the outside of the enclosure 13 relative to the seal 48, with a slide 49 whose axial length is greater than the distance between the two seals 46, 48 in the assembled position of the two enclosures with the two flanges 44 and 17 in contact with each other, as shown clearly in FIG. 6, in which it can be seen that the two ends of the slide 49 come into contact with the seals 46, 48 to break the seal and thereby establish communication between the two enclosures 1 and 13.

During assembly, the covers 11 and 22 are removed, the mobile assemblies 3 and 15 are coupled by means of the coupling members 4 and 5, the sliding jacket 24 is lowered, and the head 1 is then lowered to bring the flanges 44 and 17 into contact. A seal 50 is placed between the flanges beforehand. On completion of coupling, the slide 49 is positioned by an annular rim 51 that locates between the flange 17 and the backing flange 47 in a recess 52 in the flange 17.

FIGS. 7 to 10 show a third embodiment of the invention in a highly diagrammatic form.

The figures show in a highly diagrammatic form part of the first enclosure 1 and the second enclosure 13 with the respective internal mobile assemblies 3 and 15 and the coupling members 4 and 16. In this embodiment the annular elastomer seals are identified by the reference numbers 53 and 54.

The seals each have a first peripheral part 55, 56 gripped between a flange and a backing flange, respectively 57, 58 and 59, 60, a second part 61, 62 constituting a deformable hollow ring with walls having some parts, such as the parts 63, 64, 65, 66, that are more flexible and other parts 67, 68, 69, 70 that are more rigid, and finally a central third part 71, 72 constituting a simple thin disc providing a sliding seal along the mobile assemblies 3, 15. The central part 71, 72 can incorporate an annular enlargement 73, 74 at its end.

Prior to coupling, and as in the previous examples, the separated enclosures 1 and 13 are filled with dielectric gas at a slight overpressure of approximately 0.3 bar. On completion of assembly, filling with dielectric gas is continued until the nominal working pressure is obtained. In this third embodiment, it is this operation that "breaks" the seal provided by the seals 53 and 54 to establish communication between the two enclosures 1 and 13.

Figure 8:
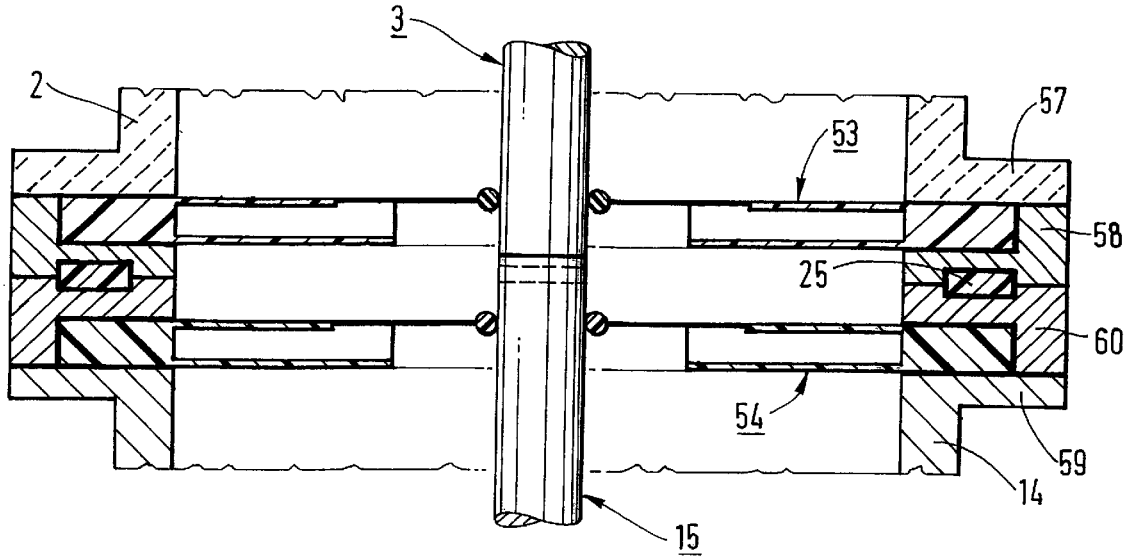
Figure 9:
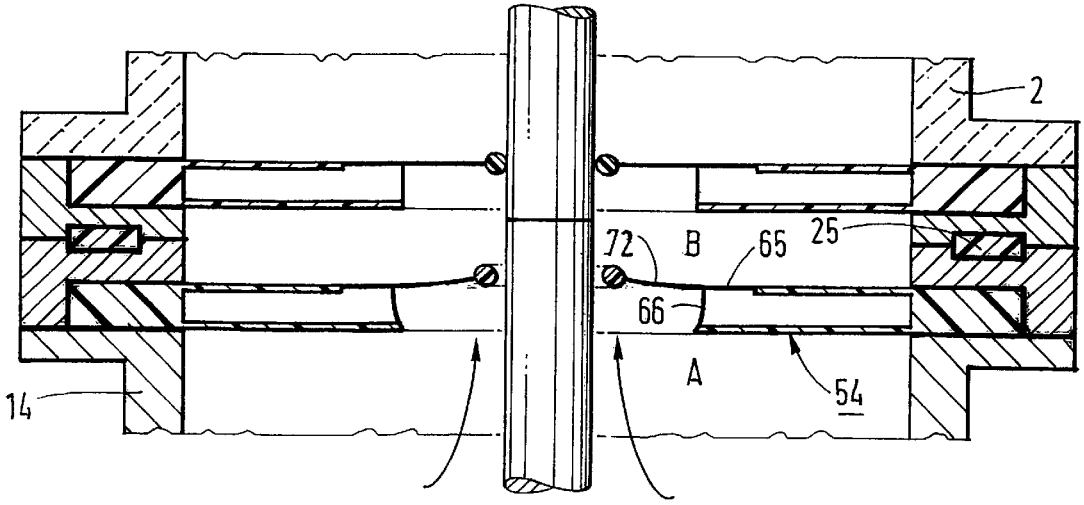
Figure 10:
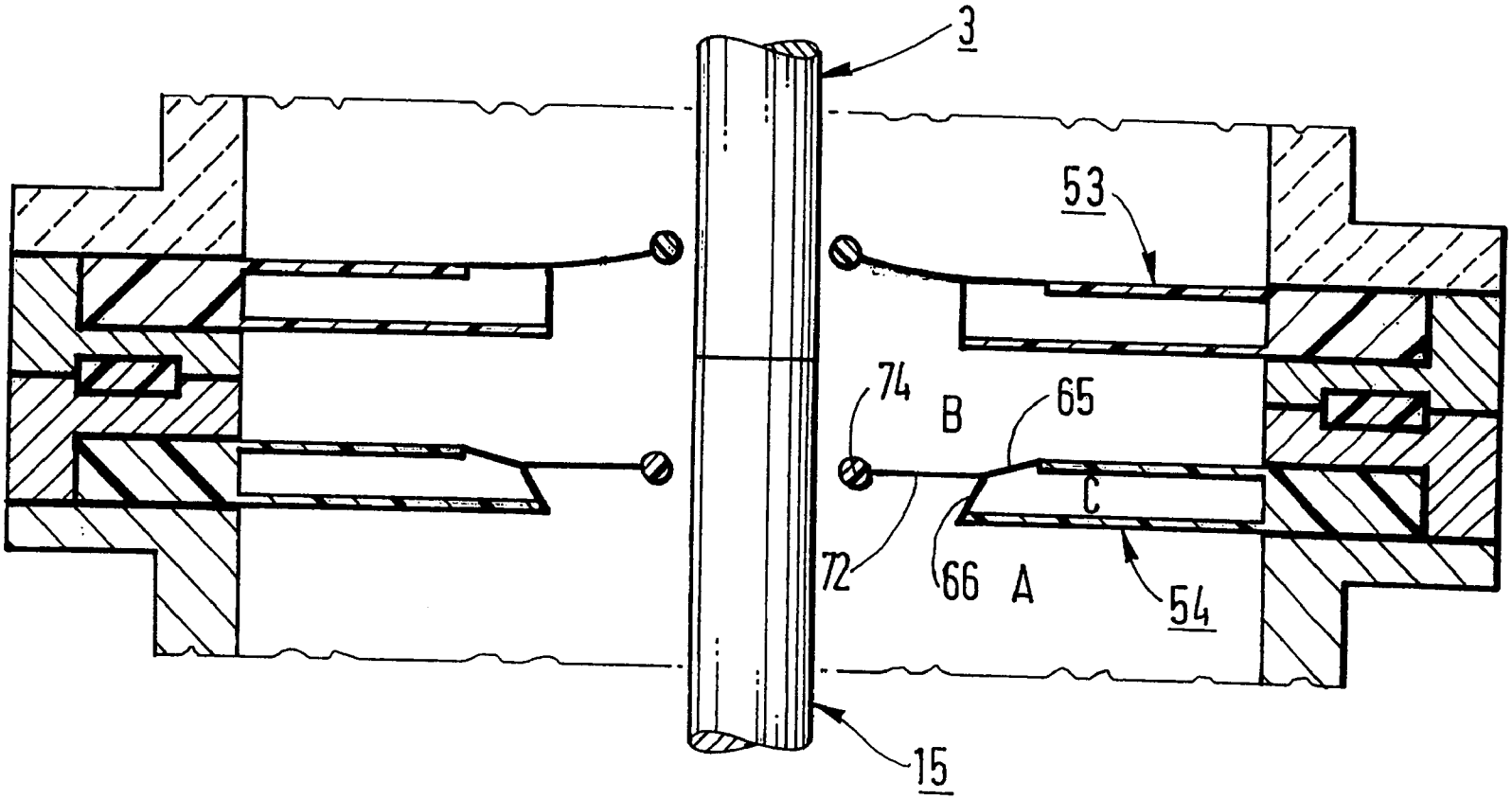

To this end, once assembly has been completed, as shown in FIG. 8, the device is filled via a valve, not shown, provided for this purpose and connected to the lower envelope 14. The pressure increases on the side A (FIG. 9), causing deformation of the parts 66 and 72 of the seal 54; after this, the pressure increases at B and the part 65 is also deformed, the seal 54 eventually reaching the position shown in FIG. 10; the pressure does not increase in the enclosed space C. The same phenomenon occurs after a short time-delay for the seal 53, which eventually assumes the same position as the seal 54. This "breaks" the seal and communication is established between the internal spaces of the two enclosures. Thus, in this case too, the deformation of the seals is reversible and automatic, and no additional operation is necessary to ensure gaseous communication between the two parts on completion of assembly or to restore the seal on disassembly. It is merely necessary, in this last example, to fill the pole with dielectric gas to the nominal pressure on completion of assembly to "break" the seal, but this operation is carried out in any case and, similarly, on disassembly, to restore the seal it is necessary to reduce the nominal overpressure, but this is carried out in any case here too.

There is claimed:

1. A pressurized gas circuit-breaker pole that is operative to be assembled and disassembled without significant loss of gas, comprising a first enclosure or pole head including a first envelope having a first connecting flange with a circular orifice, said first envelope containing a first mobile assembly terminating in a coupling member coaxial with said orifice, and a second enclosure constituting an insulative column including a second envelope having a second connecting flange with a corresponding circular orifice, said second envelope containing a second mobile assembly including a link for maneuvering said first mobile assembly and having an end including a complementary coupling member for coupling said end with said coupling member, wherein said connecting flange of each enclosure is fitted with an annular elastomer seal fixed to the corresponding connecting flange and through which the corresponding mobile assembly passes, said seal of each enclosure providing, during assembly of said flanges and coupling of said internal mobile assemblies, a sliding seal along the respective mobile assemblies, and means for breaking the seal along said mobile assemblies on completion of assembly by reversible and automatic deformation of said annular elastomer seal to establish communication between said two enclosures.

2. The circuit-breaker pole claimed in claim 1 wherein said annular elastomer seals are tilting deformable seals.

3. The circuit-breaker pole claimed in claim 2 wherein each of said tilting deformable seals includes an external anchor ring connected by an isthmus to a seal body including a heel and a lip and said heel of each seal projects beyond an exterior plane of the corresponding flange.

4. The circuit-breaker pole claimed in claim 1 wherein each of said annular elastomer seals includes a first peripheral part gripped between a flange and a backing flange, a second part constituting a deformable hollow ring including walls with more flexible parts and more rigid parts, and a central third part constituting a simple thin disc providing said sliding seal along said mobile assembly.

5. The circuit-breaker pole claimed in claim 1 wherein said means for breaking said seal along said mobile assemblies include a slide having an axial length that is greater than the distance between said two annular elastomer seals in the assembled position of said first and second envelopes.

* * * * *